United States Patent [19]

Scott-Scott

[11] 4,343,611

[45] Aug. 10, 1982

[54] MARINE PROPULSION

[75] Inventor: John L. Scott-Scott, Bulkington, England

[73] Assignee: Rolls-Royce Limited, London, England

[21] Appl. No.: 107,634

[22] Filed: Dec. 27, 1979

[30] Foreign Application Priority Data

Jan. 5, 1979 [GB] United Kingdom ..... 7900360

[51] Int. Cl.[3] ..... B63H 11/08; B63H 11/02

[52] U.S. Cl. ..... 440/45

[58] Field of Search ..... 440/63, 44, 45

[56] References Cited

U.S. PATENT DOCUMENTS 3,808,804 5/1974 Scott-Scott ..... 440/45

3,889,622 6/1975 Scott-Scott ..... 440/45

*Primary Examiner*—Richard A. Bertsch

*Attorney, Agent, or Firm*—Cushman, Darby & Cushman

[57] ABSTRACT

A marine propulsion unit which is mounted externally of a marine vessel and receives supplies of compressed air and fuel from on board the vessel, comprises a housing, a duct in the housing, containing a ventilated flow rotor, the rotor having tip blading driven by the products of combustion from combustion apparatus located in the housing.

8 Claims, 12 Drawing Figures

MARINE PROPULSION

This invention relates to a type of propulsion unit for use in high speed ships, hovercraft and hydrofoils. A majority of marine propulsion units in current use employ a mechanical power transmission to some form of screw or duct propulsor system, although alternative transmission systems are available, they are generally restricted to low shaft horsepowers. The problems of using these conventional power transmission systems become severe when very large horsepowers have to be transmitted, particularly when the power has to be taken through a strut or fairing to an underwater propulsion unit. In such cases, the use of compressed gas can be attractive as the power transmission medium.

The present invention seeks to provide a marine propulsion unit in which a compressed gas is used as the power transmission medium.

The present invention provides a marine propulsion unit comprising a housing having a duct through which water is capable of flowing, a ventilated flow rotor rotatably mounted in said duct, means for discharging a flow of ventilating gas into the duct, combustion means arranged to receive a flow of compressed air and fuel, the rotor having driving blading arranged to be driven by the products of combustion from the combustion means.

The compressed gas may be supplied to the rotor blading by a remotely located compressor, e.g. in the hull of the marine vessel, which is driven by any suitable form of prime mover, e.g. a diesel engine, steam or gas turbine.

The rotor driving blading may comprise one or more stages of blades secured to the rim of the rotor and associated numbers of stages of stator blades secured to the duct structure.

The rotor may be mounted on a shaft which is cantilevered from a number of radially extending arms located at the upstream end of the duct, the rotor being retained on the shaft by a retaining thrust block.

Some of the compressed gas, which is preferably compressed air, is injected into the duct either upstream or downstream of the rotor through discharge means which may comprise ducting in the or each of the shaft supporting arms and the shaft.

Figure 1:
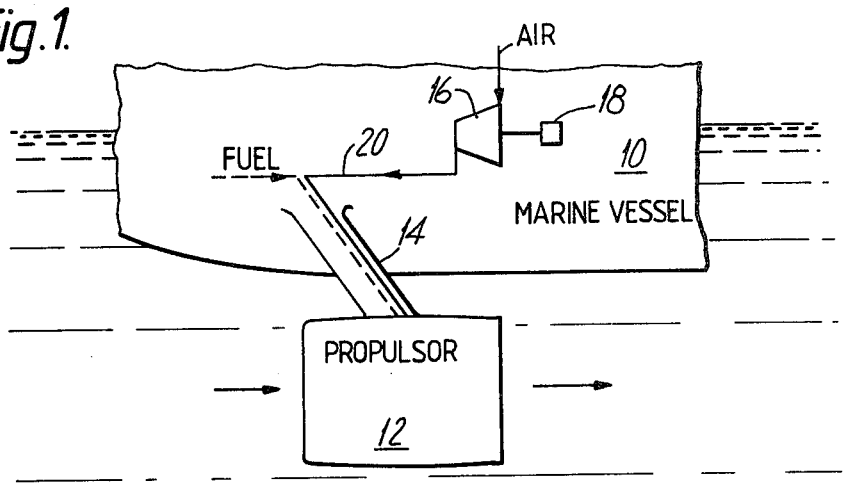
Figure 2:
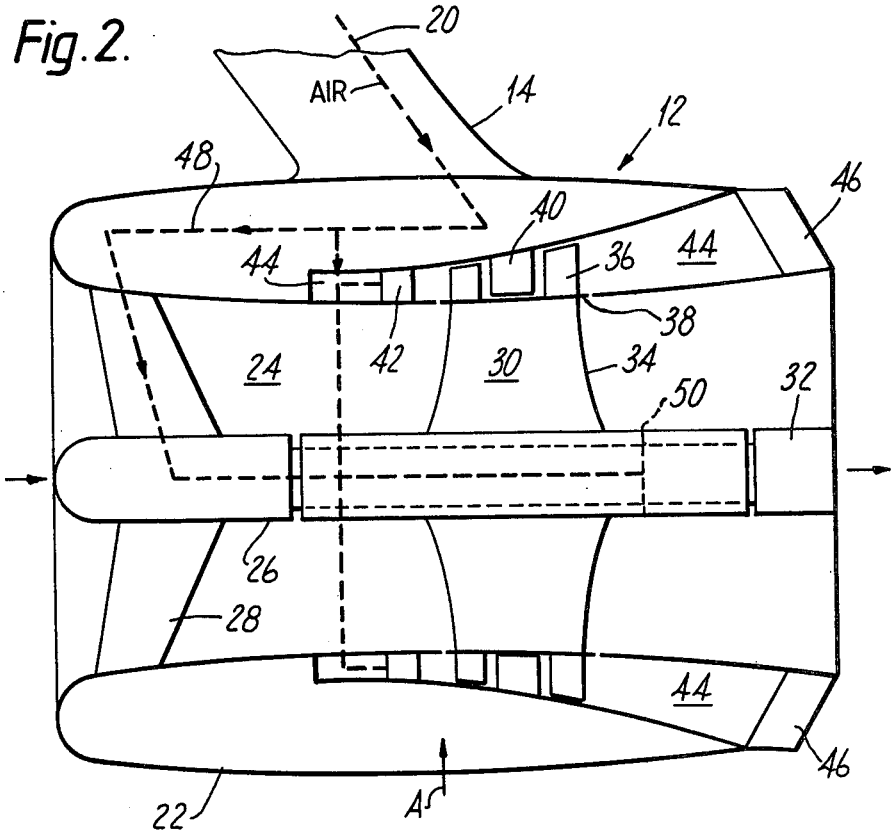
Figure 3:
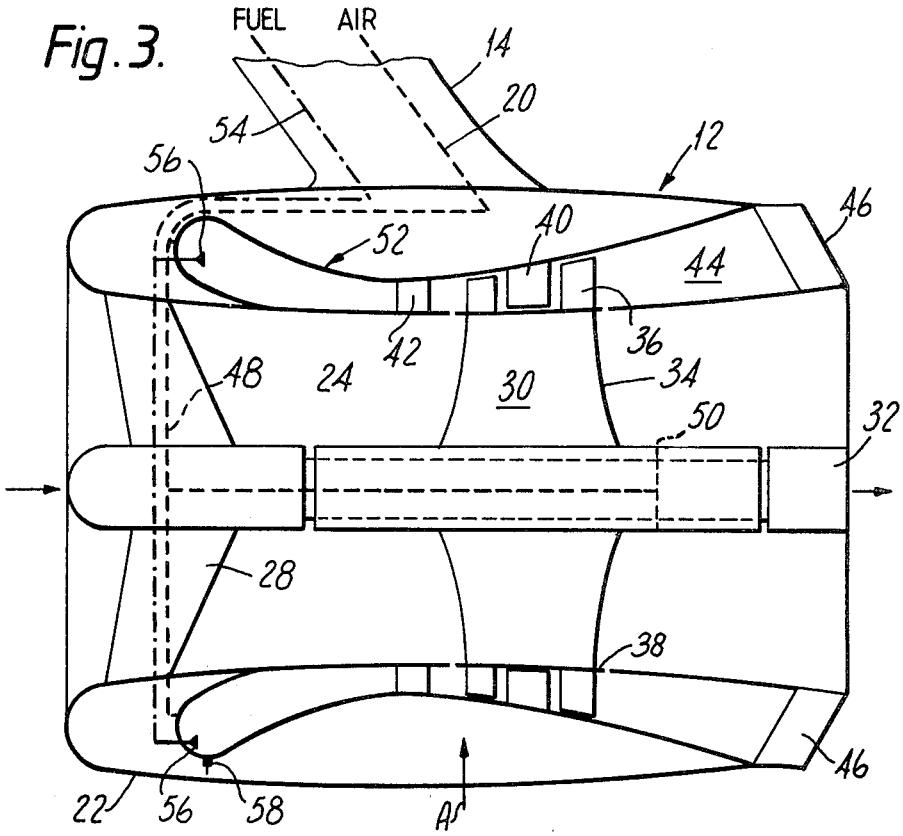
Figure 4:
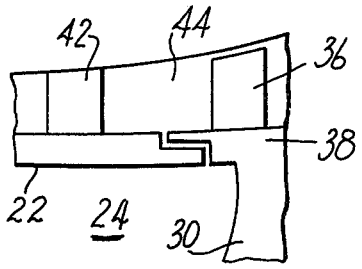
Figure 5:
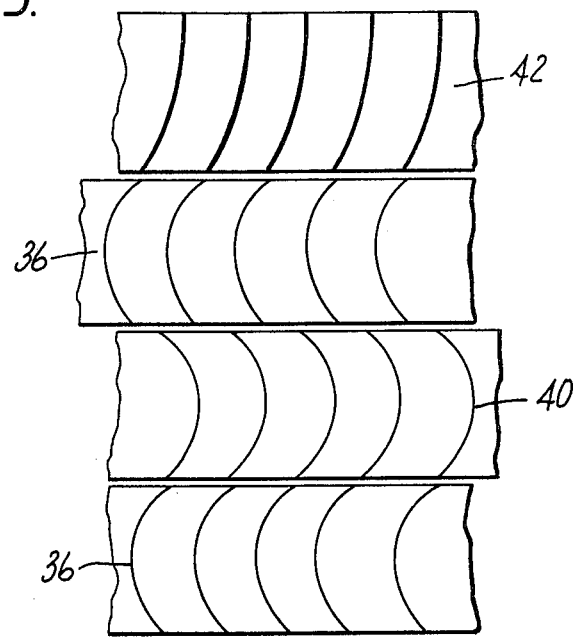
Figure 6:
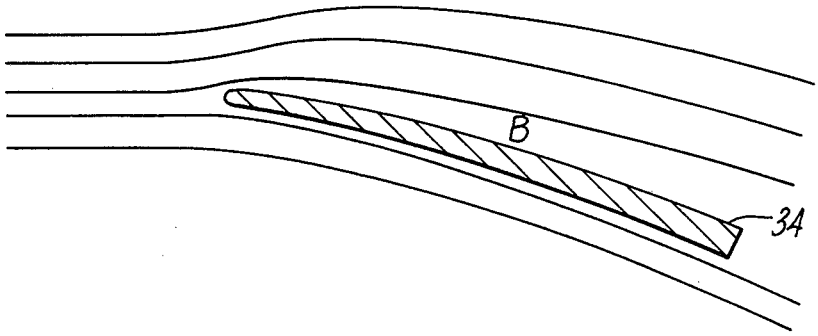
Figure 7:
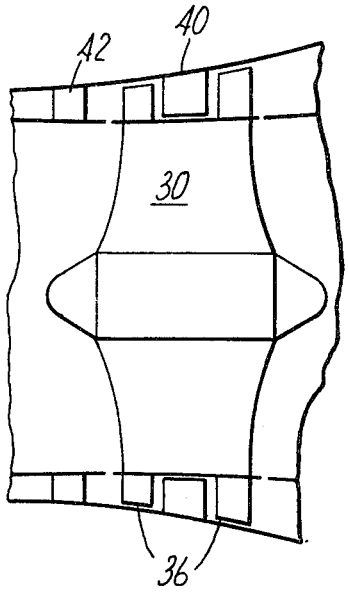
Figure 8:
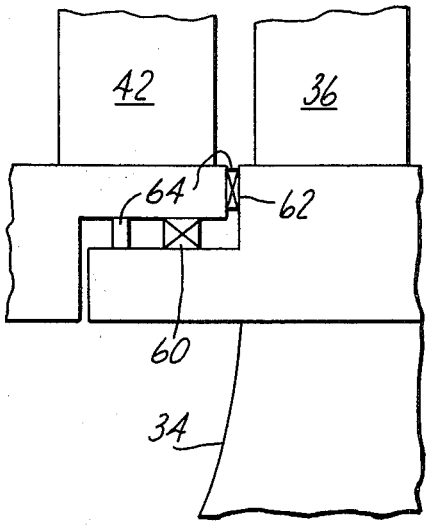
Figure 9:
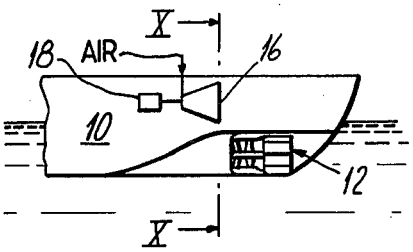
Figure 10:
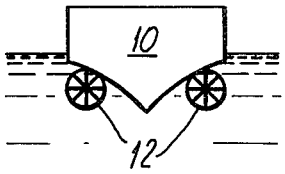
Figure 11:
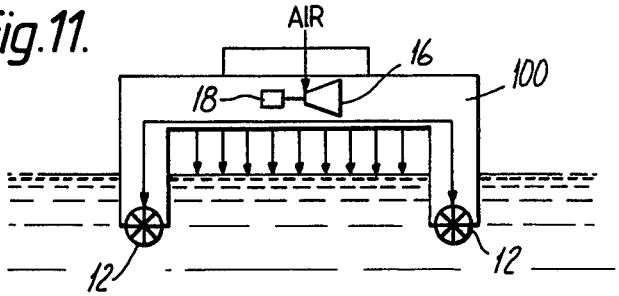
Figure 12:
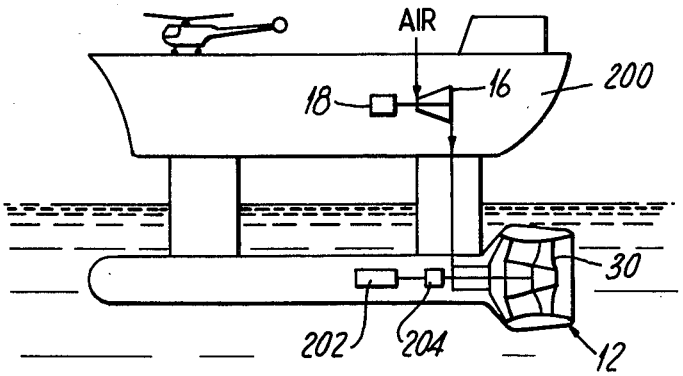

The present invention will now be more particularly described with reference to the accompanying drawings in which;

FIG. 1 shows a general arrangement of part of a marine vessel and a propulsion unit according to the present invention, FIG. 2 shows a schematic arrangement in more detail of the marine propulsion unit shown in FIG. 1, FIG. 3 shows a schematic arrangement of a modified form of marine propulsion unit to that shown in FIG. 2, FIG. 4 shows a detailed view of part of the marine propulsion unit shown in FIGS. 2 and 3, FIG. 5 is a diagrammatic view to an enlarged scale on arrow A in FIGS. 2 and 3 showing the driving blading of the propulsion unit in more detail, FIG. 6 is a view on an enlarged scale of one of the rotor blades of the propulsion units shown in FIGS. 2 and 3 showing a typical flow field during operation, FIG. 7 is a part view of a modification of the propulsion units, shown in FIGS. 2 and 3, FIG. 8 is a view to an enlarged scale of part of the modification shown in FIG. 7, FIG. 9 is a view of part of a marine vessel in which two propulsion units according to the present invention are integrated with the vessel hull, FIG. 10 is a section on line X—X in FIG. 9, FIG. 11 is a schematic view of a surface effect vessel incorporating two propulsion units according to the present invention, and FIG. 12 is a diagrammatic view of a marine vessel of the SWATH type incorporating one or more propulsion units according to the present invention.

Referring to FIGS. 1 and 2, a marine vessel 10, only part of which is shown and can be a conventional displacement vessel, a hovercraft, hydrofoil, or other marine vessel has one or more propulsion units 12 attached to it by means of corresponding struts 14.

The hull of the vessel 10 contains a compressor 16 driven by a prime mover 18 which can be of any suitable type, such as a diesel engine or a steam or gas turbine. The compressor delivers a supply of compressed gas in this case, compressed air to the or each propulsion unit 12 via ducting 20.

Each propulsion unit 12 comprises a housing 22 containing a central open-ended duct 24 which contains a shaft 26 whose axis is coincident with the duct axis. The shaft is supported in a cantilevered manner from a number of equi-spaced radially extending arms 28 which are attached to the housing 22 at its upstream end.

A bladed ventilated flow rotor 30 is mounted for rotation on the shaft 26 and is retained thereon by a blunt-based retaining thrust block 32. The rotor has blades 34 which extend across the duct 24 and further driving blades 36 which are mounted on a platform 38 secured to the tips of the blades 34.

The blades 36 are arranged in two stages and cooperate with a single stator stage of blades 40 and a stage of nozzle guide vanes 42 to form a turbine to drive the rotor 30. The vanes 42 and the rotor and stator blades 40 and 36 are disposed in a gas passage 44 which receives the compressed air through the ducting 20 and discharges the spent air downstream of the propulsion unit 12 past support struts.

The guide vanes 42, the rotor blades 36 and the stator blades 40 form a velocity compounded impulse turbine known as a Curtis stage and are shown in more detail in FIG. 5.

The nozzles formed by the guide vanes 42 are arranged to drop the static pressure of the compressed air to the static pressure of the water flowing in the duct 24. Thus the pressures in the ducts 24 and 44 are approximately equal and no seals are required between the platform 38 and the inner wall of the passage 44.

Some of the compressed air is tapped off from the ducting 20 and is injected into the duct 24 via discharge means which comprises ducting 48 extending through one or more of the arms 28 and the shaft 26 and outlets 50 downstream of the rotor 30.

FIG. 3 shows a propulsion unit 12 similar to that shown in FIG. 2 except for the addition of combustion apparatus 52 located in the housing 22. The combustion apparatus, which may comprise a number of equi-spaced combustion cans, or a wholly annular combustion chamber or a combination of separate cans within an annular housing, is arranged to receive fuel through ducting 54 from a tank (not shown) in the vessel 10 and to inject the fuel into the combustion apparatus through fuel injectors 56. Also provided are igniter means to ignite the fuel/air mixture in the combustion apparatus 52.

FIG. 4 shows in more detail, the relationship between the rotating platform of the rotor 30 and the static part of the housing 22 to which it is adjacent.

FIG. 6 shows a typical flow field around one of the ventilated flow rotor blades 34. The pressure surface is wetted and the suction surface is dry because the fluid which passes over the suction surface breaks away at the leading edge and the injected air has filled the space B. This type of flow field is analogous to super-cavitating flow except that the space B which extends over the whole blade span is filled with air at or about atmospheric pressure rather than water vapour which is the case in normal unventilated super-cavitating flow. The advantages of the ventilated flow field are that: (a) no damage can be caused to the blades 34 due to the collapse of the water vapour bubbles, (b) vibration is reduced, (c) noise level is decreased due to the absence of collapsing water vapour bubbles and (d) the rotor efficiency is increased since the skin-friction is lower because the suction surface of each blade is not wetted.

FIGS. 7 and 8 show a method of mounting the rotor 30 without the use of a shaft and therefore any means of supporting the shaft. The rotor is mounted at its rim by means of journal bearings 60 and thrust bearings 62, seals 64 can be provided to cope with any leakage of water or gas.

Referring to FIG. 2, in operation compressed air from the compressor 16 passes into the gas passage 44 and drives the rotor 30 by reacting with the blading 36 which is, as described an impulse turbine, the spent air passing out of the propulsion unit 12 past the support struts 46. The rotation of the rotor 30 which corresponds to a propeller induces a propulsive flow of water through the duct 24 and a flow of ventilating air is injected into flow downstream of the rotor through outlets 50. The flow of compressed air through the outlets 50 which need only be about 5% of the compressor delivery flow, provides a clean, stable flow field. The ventilated rotor operates with an energy interchange (i.e. shaft horsepower input to kinetic energy output) of 90% or more.

A more efficient propulsion unit is shown in FIG. 3 in which the energy contained in the compressed gas supply to the impulse turbine is increased by burning liquid or gaseous fuel in the combustion apparatus 52 and supplying the products of combustion to the impulse turbine. The overall efficiency of such a system is greater than that shown in FIG. 2 because the arrangement of an air-compressor on the vessel and an air turbine under water simply comprises an energy transmission system whereas the arrangement of an air compressor on the vessel, combustion equipment and turbine under water forms a gas turbine power plant. It has been calculated that the overall fuel consumption of the arrangement shown in FIG. 3 can be of the order 25% less than that of the arrangement shown in FIG. 2.

In FIGS. 9 and 10, instead of each propulsion unit 12 being attached to the vessel by a strut, the units can be positioned in a concave recess formed at the vessel stern to reduce drag. The units 12 can be of the type shown in FIG. 2 or FIG. 3.

In FIG. 11, two propulsion units 12, either as shown in FIG. 2 or FIG. 3 are located at the base of the legs of a surface effect vessel 100.

FIG. 12 shows the application of propulsion units 12 either as shown in FIG. 2 or FIG. 3 to a vessel 200 of the SWATH type, i.e. Small Waterplane Area Twin Hull, in which the main hull of the vessel is supported clear of the waterline by struts which are attached to two or more submerged hulls.

In the arrangement shown a propulsion unit 12 is mounted at the stern of each submerged hull and receives a supply of compressed air from the compressor 16. At relatively slow speeds, the units 12 need not be operated by the compressor 16 and each rotor 30 can be driven by a diesel engine 202 via a clutch 204. For relatively high speeds, the engines 202 can be disconnected, and the propulsion units can be operated as described with reference to FIGS. 2 and 3.

I claim:

1. A marine propulsion unit comprising:

a housing;

a duct extending through said housing and through which water is capable of flowing, said duct having an open upstream end and an open downstream end;

a ventilated flow rotor rotatably mounted in said duct to cause water to flow through said duct;

an exhaust passage in said housing external of said duct, said exhaust gas passage having a downstream end adjacent to but separated from the downstream end of said duct;

combustion means arranged to receive a flow of compressed air and fuel, said combustion means communicating with said exhaust gas passage;

a velocity compounded impulse turbine in said exhaust gas passage and driven by products of combustion from said combustion means, said velocity compound impulse turbine having blading directly connected to said rotor for driving said rotor;

a source of gas under pressure;

and means for discharging a flow of the gas from said source into said duct adjacent said rotor in a quantity just sufficient to cause said rotor to operate in a ventilated flow field.

2. A unit as claimed in claim 1 in which the rotor is rotatably mounted on a shaft which is cantilevered from the housing.

3. A unit as claimed in claim 1 in which the rotor is mounted in the duct on bearings which are located between the housing and a rim of the rotor.

4. A unit as claimed in claim 1 in which said velocity compounded impulse turbine comprises at least two rows of blading directly attached to said rotor and a row of stator blades located between the rows and attached to said housing.

5. A unit as claimed in any of claims 1, 4, 2, or 3 in which the gas from said source comprises compressed air and the discharge means comprises ducting having outlets adjacent the downstream face of the rotor.

6. A unit as claimed in claim 5 in which the compressed air for said discharge means is tapped from the flow of compressed air to said combustion means.

7. A unit as claimed in claim 1, the unit being mounted externally of a marine vessel on support means and receiving compressed air and fuel from a source on board the marine vessel.

8. A unit as claimed in claim 1 in which said combustion means is positioned in said housing external of said duct.

* * * * *